US010510467B2

(12) United States Patent
Gundel

(10) Patent No.: US 10,510,467 B2
(45) Date of Patent: Dec. 17, 2019

(54) SHIELDED CABLE

(71) Applicant: 3M INNOVATIVE PROPERTIES COMPANY, St. Paul, MN (US)

(72) Inventor: Douglas B. Gundel, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 299 days.

(21) Appl. No.: 14/442,744

(22) PCT Filed: Dec. 2, 2013

(86) PCT No.: PCT/US2013/072555
§ 371 (c)(1),
(2) Date: May 14, 2015

(87) PCT Pub. No.: WO2014/088930
PCT Pub. Date: Jun. 12, 2014

(65) Prior Publication Data

US 2015/0294766 A1 Oct. 15, 2015

Related U.S. Application Data

(60) Provisional application No. 61/734,156, filed on Dec. 6, 2012.

(51) Int. Cl.

| | |
|---|---|
| ***H01B 7/08*** | (2006.01) |
| ***H01B 11/04*** | (2006.01) |
| ***H01B 11/06*** | (2006.01) |
| ***H01B 7/00*** | (2006.01) |

(52) U.S. Cl.
CPC ..... *H01B 11/06* (2013.01); *H01B 7/0045* (2013.01)

(58) Field of Classification Search
CPC ..... H01B 11/04; H01B 7/08
USPC ..... 174/113 R, 117 F
See application file for complete search history.

(56) References Cited

U.S. PATENT DOCUMENTS

| | | | |
|---|---|---|---|
| 3,775,552 | A | 11/1973 | Schumacher |
| 4,149,026 | A | 4/1979 | Fritz et al. |
| 4,382,236 | A | 5/1983 | Suzuki |
| 4,468,089 | A | 8/1984 | Brorein |
| 4,481,379 | A | 11/1984 | Bolick et al. |

(Continued)

FOREIGN PATENT DOCUMENTS

| | | |
|---|---|---|
| EP | 0 082 700 | 6/1983 |
| EP | 0 366 046 | 5/1990 |

(Continued)

OTHER PUBLICATIONS

PCT International Search Report for PCT/US2013/072555, dated Mar. 11, 2014, 5 pages.

(Continued)

*Primary Examiner* — Chau N Nguyen
(74) *Attorney, Agent, or Firm* — Robert S. Moshrefzadeh

(57) ABSTRACT

Shielded cables (200) are described. More specifically, shielded cables (200) that include a plurality of separate individual conductor sets (210) are described. The individual conductor sets (210) include two or more insulated conductors, first and second conductive shielding films, and an insulating jacket surrounding the plurality of conductor sets. A variety of potential cable shapes and configurations are also described.

15 Claims, 2 Drawing Sheets

(56) References Cited

U.S. PATENT DOCUMENTS

| | | | | |
|---|---|---|---|---|
| 4,780,157 | A | 10/1988 | Coon | |
| 5,250,127 | A | 10/1993 | Hara | |
| 5,446,239 | A | 8/1995 | Mizutani et al. | |
| 6,043,434 | A * | 3/2000 | Prudhon | H01B 7/0009 174/113 R |
| 6,452,107 | B1 * | 9/2002 | Kebabjian | H01B 11/002 174/113 R |
| 6,717,058 | B2 | 4/2004 | Booth et al. | |
| 7,807,927 | B2 | 10/2010 | Yeh | |
| 8,143,522 | B2 * | 3/2012 | Laudenslager | H01B 11/085 174/110 R |
| 8,859,902 | B2 * | 10/2014 | Matsuda | H01B 11/002 174/102 R |
| 8,946,556 | B2 * | 2/2015 | Sunaga | H01B 11/203 174/102 R |
| 9,129,724 | B2 | 9/2015 | Gundel | |
| 2003/0213610 | A1 | 11/2003 | Ide et al. | |
| 2006/0016615 | A1 | 1/2006 | Schilson et al. | |
| 2007/0240898 | A1 | 10/2007 | Reichert et al. | |
| 2010/0025072 | A1 | 2/2010 | Okano et al. | |
| 2011/0278043 | A1 | 11/2011 | Ueda et al. | |
| 2012/0090866 | A1 | 4/2012 | Gundel | |
| 2012/0090872 | A1 | 4/2012 | Gundel | |
| 2012/0090873 | A1 | 4/2012 | Gundel | |
| 2012/0097421 | A1 | 4/2012 | Gundel | |

FOREIGN PATENT DOCUMENTS

| | | |
|---|---|---|
| EP | 0 903 757 | 3/1999 |
| EP | 2 383 754 | 11/2011 |
| GB | 1 546 609 A | 5/1979 |
| JP | H11-144532 | 5/1999 |
| JP | 2002-304921 | 10/2002 |
| JP | 2003-249128 | 9/2003 |
| JP | 2004-87189 | 3/2004 |
| WO | WO 2010/148157 | 12/2010 |

OTHER PUBLICATIONS

De Araujo, D.N. et al. "Full-Wave, TwinAx, Differential Cable Modeling", IEEE, 2008 Electronic Components and Technology Conference, pp. 1684-1689.

* cited by examiner

SHIELDED CABLE

BACKGROUND

Cables designed for use external to a metal enclosure such as a computer housing are typically jacketed in a thick dielectric material to provide flammability and abrasion resistance and physical durability. Such cables are often further shielded in a conductive metal foil or braid in order to contain electromagnetic fields and prevent them from radiating into the external environment or interfering with other electrical or electronic systems.

SUMMARY

In one aspect, the present disclosure relates to cables that include a plurality of separate individual conductor sets, each conductor set extending along a length of the cable. In some embodiments, each conductor set includes two or more insulated conductors and first and second conductive shielding films disposed on opposite first and second sides of the conductor set. The first and second conductive shielding films include cover portions and pinched portions arranged such that, in transverse cross section, the cover portions of the first and second shielding films in combination substantially surround the conductor set, and the pinched portions of the first and second shielding films in combination form pinched portions of the conductor set on each side of the conductor set, each pinched portion having an edge extending along the length of the cable.

DETAILED DESCRIPTION

Figure 1:
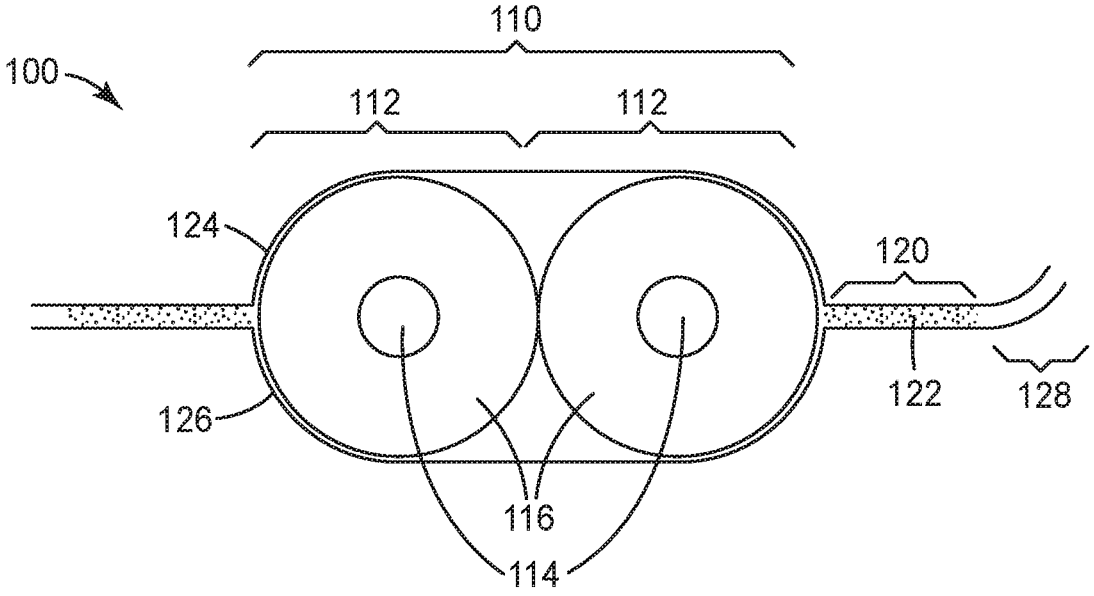
FIG. 1 is a schematic cross-sectional view of an individual conductor set.

FIG. 1 is a schematic cross-sectional view of an individual conductor set. Conductor set 100 includes cover portion 110 and pinched portions 120. Within cover portion 110 are disposed insulated conductors 112 each including conducting wire 114 and dielectric insulator 116. Pinched portions 120 include adhesive 122. First conductive shielding film 124 and second conductive shielding film 126 bound both cover portion 110 and pinched portions 120. At the edge of conductor set 100 may be bent portion 128.

Cover portion 110 may be any suitable shape and may be of any suitable dimensions. In some embodiments, a shape of cover portion 110 may be selected to accommodate a plurality of insulated conductors 112. For example, in embodiments where insulated conductors 112 are, in a transverse cross section, substantially circular, it may be suitable for parts of cover portion 110 to accommodate these shapes with similarly curved geometry.

Insulated conductors 112 each include conducting wire 114 and dielectric insulator 116. Conducting wire 114 can include any suitable electrically conductive material, and may be selected for its electrical or physical properties, for example, conductivity, coefficient of thermal expansion, malleability, or ductility. Suitable materials include copper, aluminum, and silver. Similarly, dielectric insulator 116 can include any suitable dielectric material for insulating conducting wire 114 and may be selected for flexibility, melting point, dielectric constant, or any other physical or electrical property or properties. Suitable materials include polyethylene, polyethylene foam, or polytetrafluoroethylene. The materials for both conducting wire 114 and dielectric insulator 116 may be selected to give an overall nominal characteristic impedance for insulated conductor 112 in the range of 40-60 ohms, 45-55 ohms, 70-110 ohms, 80-100 ohms, or some other desired range.

In some embodiments, insulated conductors 112 may be in contact, in other embodiments insulated conductors 112 may be separated either by an air gap or alternatively with a physical barrier or spacer. While two insulated conductors 112 are depicted as being within cover portion 110, any number of insulated conductors may be arranged in any suitable configuration within conductor set 100. In some embodiments, it may be desirable for insulated conductors 112 to have the same shape and size, particularly because in many embodiments insulated conductors 112 affect the possible shapes of cover portion 110. In some embodiments, a wire diameter of each insulated conductor 112 is not greater than 20, 21, 22, 23, 24, 26, 27, 28, or 29 AWG.

Cover portion 110 may optionally also include one or more drain wires. While not pictured in the schematic of FIG. 1, these drain wires may, in some embodiments, be disposed between insulated conductors 112 within cover portion 110 or outside of cover portion 110. If drain wire is outside cover portion 110 it may still nonetheless be in physical or at least electrical contact with the outer conductive shielded films or other outer surface of conductor set 100. Electrical contact may be either capacitive or resistive.

Pinched portions 120 may be located on either end of cover portion 110. In some embodiments, pinched portions 120 may secure first conductive shielding film 124 to second conductive shielding film 126 to prevent delamination. Pinched portions 120 may include adhesive 122 to attach first conductive shielding film 124 to second conductive shielding film 126, or due to physical properties of the conductive shielding films such as rigidity, conductor set 100 may resist delamination inherently. In embodiments including adhesive 122, due to the pinching of the conductive shielding films to form cover portion 110 and pinched portions 120, there may be a gap within pinched portions 120 that remains unfilled with adhesive 122. Any suitable adhesive may be used. In some embodiments the conductive shielding films may be attached by a mechanical interlock through a process such as clinching. Pinched portions 120 may also include one or more drain wires.

First conductive shielding film 124 and second conductive shielding film 126 may be formed from any suitable material and may be of any suitable thickness. Suitable conductive materials include copper, aluminum, and silver.

Bent portion 128 may be at one or more ends of conductor set 100. In some embodiments, bent portion 128 may include some of adhesive 122. Bent portion 128 may be sealed or it may be open or partially open as shown in FIG. 1. Because FIG. 1 depicts a transverse cross-section of a conductor set, bent portion 128 may be an unsealed or sealed edge that runs along the length of conductor set 100. Bent portion 128 may be curved or arc-like, it may have a sharp angle, or it may be some combination of the two. Ends of pinched portions 120, including bent portion 128 may, in some embodiments, be part of a free edge extending along conductor set 100 in the direction of a cable.

The proportions and relative size of cover portion 110 and pinched portions 120 may be selected for the particular application or configuration. For example, in some embodiments the length of cover portion 110 may exceed the length of pinched portions 120. In some embodiments the cover portion 110 may encompass at least 70%, 80%, 90%, or 95% of a periphery of conductor set 100. Relative dimensions of cover portion 110 and pinched portions 120 may be chosen to provide a particular overall shape profile or particular electrical performance.

Individual conductor sets may be fabricated through any suitable process. In some embodiments, conductor sets are fabricated individually, but they may also be formed together as part of a web or sheet and later cut into individual or singulated conductor sets.

Figure 2:
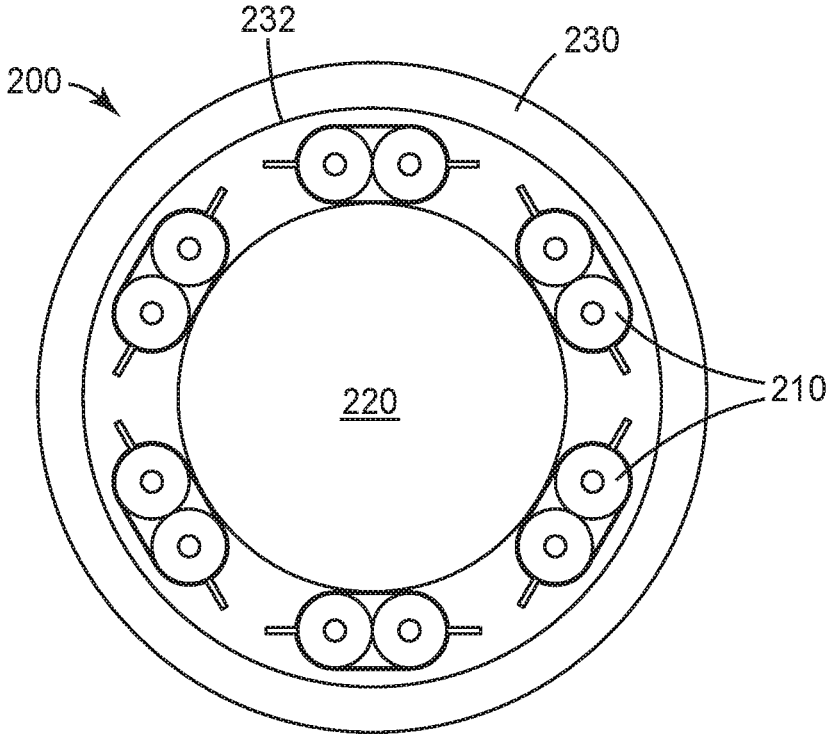
FIG. 2 is a schematic cross-sectional view of a cable including a plurality of the separate individual conductor sets of FIG. 1.

FIG. 2 is a cross-sectional schematic view of a cable including a plurality of the conductor sets illustrated in FIG. 1. Cable 200 includes individual conductor sets 210, core 220, and jacket 230. Individual conductor sets 210 correspond with conductor set 100 of FIG. 1; for ease of illustration any bent portions are not shown.

Core 220 may be any suitable material and any suitable size or shape. In some embodiments, core 220 is an insulating core. Suitable materials for insulating cores include polymers such as polycarbonate, polyethylene, or PTFE. The material of core 220 may be selected for its electrical insulation properties or it may be selected for its physical properties, including flexibility, durability, or warp resistance. In some embodiments, core 220 may be selected for its rigidity to help maintain the overall shape, configuration, and form of cable 200. Core 220, while depicted as being centered in cable 200, may instead be in any suitable arrangement in conjunction with conductor sets 210. Dual- and multi-core configurations may be desirable in some applications. Core 220 also need not be at the center of a perimeter of conductor sets 210, and such cores may be used instead to fill gaps and corners to achieve desired cable shape, stability, rigidity, or electrical properties.

Jacket 230 may similarly be any suitable material to impart desirable external properties on cable 200, such as abrasion or fire-resistance. In some embodiments, a flexible material may be selected to preserve desired physical properties of cable 200. Jacket 230 may also be thick to prevent damage or wear to the internal conductor sets 210 associated with use. In some embodiments, jacket 230 may also include one or more conductive layers 232 along the interior perimeter of jacket 230, such as a braided copper layer or silver plating. Conductive layers may help prevent electromagnetic fields within the cable from radiating into the external environment or from interfering with nearby electronic components.

The overall arrangement of conductor sets 210 and core 220 may vary widely depending on the desired shape of the cable. Closely matching the shape of the internal components with jacket 230 and the desired overall cross-sectional shape of cable 200 may increase strength and durability of the cable. For example, a roughly flat or square internal configuration with a circular jacket may be more prone to warping as the external shape may begin to conform to the internal shape. Accordingly, circular cable shapes may be achieved through many configurations, examples thereof depicted in FIG. 2 and FIG. 3. The separateness of the individual conductor sets may provide greater design flexibility in configuring desirable overall cable shapes. Each cable may contain any number of cores and conductor sets; for example, 2, 4, 6, or 8 of either or each.

Cable 200 in FIG. 2 may extend in the direction of in or out of the page. In some embodiments, the extended individual conductor sets 210 (i.e., the individual conductor set wires) may be twisted around a center axis in order to even out any undesirable electrical effects of bending or deforming cable 200 during normal use. In some embodiments individual conductor sets 210 may be twisted around core 220. Each of conductor sets 210 may extend along the entire length of cable 200. In some embodiments, individual conductor sets 210 each include a drain wire.

Figure 3:
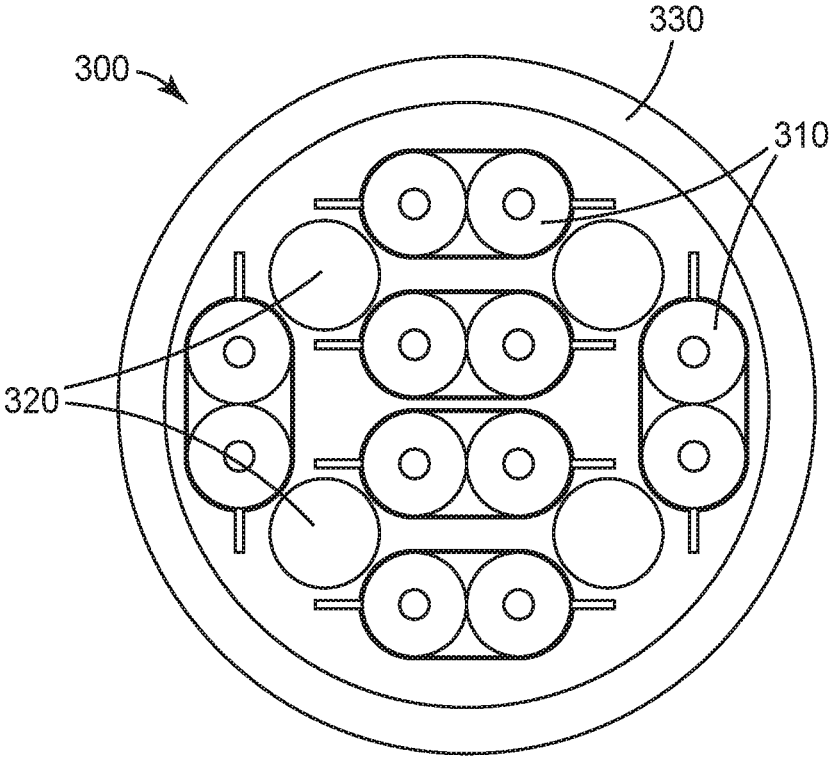
FIG. 3 is a schematic cross-sectional view of another cable including a plurality of the separate individual conductor sets of FIG. 1.

FIG. 3 is a cross-sectional schematic view of another cable including a plurality of the individual conductor sets of FIG. 1. Cable 300 includes conductor sets 310, corresponding with conductor sets 210 of FIG. 2 and conductor set 100 FIG. 1, cores 320, corresponding with core 220 of FIG. 2, and jacket 330, corresponding with jacket 220 of FIG. 2.

Cable 300 is very similar to cable 200 of FIG. 2; however, cable 300 has a different configuration, depicting the utilization of four cores 320 instead of the single, centrally located core 220 depicted in FIG. 2. FIG. 3 also depicts four conductor sets along an interior perimeter of cable 300 while two conductor sets are disposed within the interior perimeter. FIG. 3 helps illustrate the variations in cable configuration that are possible utilizing individual conductor sets 310. In FIG. 3, each of cores 320 is disposed between two of conductor sets 310 located on an inner perimeter of cable 300. Cores 320 may provide strength to cable 300, may maintain a certain shape profile, may prevent conductive outer films of individual conductor sets 310 from contacting one another, or any combination of the preceding.

Cables may have any suitable cross section, including circular, elliptical, rectangular, square, or polygonal. Likewise, cores used in embodiments of the present disclosure may have any suitable cross section, including round or circular. In some embodiments, a cross-sectional shape of the cores may be selected to provide for the filling of a gap between individual conductor sets.

The following are items of the present disclosure.

Item 1 is a cable comprising:

a plurality of separate individual conductor sets, each conductor set extending along a length of the cable and comprising:

two or more insulated conductors;

first and second conductive shielding films disposed on opposite first and second sides of the conductor set, the first and second conductive shielding films including cover portions and pinched portions arranged such that, in transverse cross section, the cover portions of the first and second shielding films in combination substantially surround the conductor set, and the pinched portions of the first and second shielding films in combination form pinched portions of the conductor set on each side of the conductor set, each pinched portion comprising an edge extending along the length of the cable; and an insulating jacket surrounding the plurality of the conductor sets.

Item 2 is the cable of item 1 further comprising an outer shielding film surrounding the plurality of the conductor sets, the insulating jacket surrounding the outer shielding film.

Item 3 is the cable of item 1 further comprising an adhesive layer bonding the first shielding film to the second shielding film in the pinched portions of the conductor set.

Item 4 is the cable of item 1 comprising 4 separate individual conductor sets.

Item 5 is the cable of item 1 comprising 6 separate individual conductor sets.

Item 6 is the cable of item 1 comprising 8 separate individual conductor sets.

Item 7 is the cable of item 1, wherein each conductor set extends along the entire length of the cable.

Item 8 is the cable of item 1, wherein a wire diameter of each insulated conductor of each conductor set in the plurality of separate individual conductor sets is not greater than 20 AWG.

Item 9 is the cable of item 1, wherein a wire diameter of each insulated conductor of each conductor set in the plurality of separate individual conductor sets is not greater than 21 AWG.

Item 10 is the cable of item 1, wherein a wire diameter of each insulated conductor of each conductor set in the plurality of separate individual conductor sets is not greater than 22 AWG.

Item 11 is the cable of item 1, wherein a wire diameter of each insulated conductor of each conductor set in the plurality of separate individual conductor sets is not greater than 23 AWG.

Item 12 is the cable of item 1, wherein a wire diameter of each insulated conductor of each conductor set in the plurality of separate individual conductor sets is not greater than 24 AWG.

Item 13 is the cable of item 1, wherein a wire diameter of each insulated conductor of each conductor set in the plurality of separate individual conductor sets is not greater 26 AWG.

Item 14 is the cable of item 1, wherein a wire diameter of each insulated conductor of each conductor set in the plurality of separate individual conductor sets is not greater than 27 AWG.

Item 15 is the cable of item 1, wherein a wire diameter of each insulated conductor of each conductor set in the plurality of separate individual conductor sets is not greater than 28 AWG.

Item 16 is the cable of item 1, wherein a wire diameter of each insulated conductor of each conductor set in the plurality of separate individual conductor sets is not greater than 29 AWG.

Item 17 is the cable of item 1, wherein each insulated conductor of each conductor set in the plurality of separate individual conductor sets has a nominal characteristic impedance in a range of 40-60 ohms.

Item 18 is the cable of item 1, wherein each insulated conductor of each conductor set in the plurality of separate individual conductor sets has a nominal characteristic impedance in a range of 45-55 ohms.

Item 19 is the cable of item 1, wherein each insulated conductor of each conductor set in the plurality of separate individual conductor sets has a nominal characteristic impedance in a range of 70-110 ohms.

Item 20 is the cable of item 1, wherein each insulated conductor of each conductor set in the plurality of separate individual conductor sets has a nominal characteristic impedance in a range of 80-100 ohms.

Item 21 is the cable of item 1, wherein each conductor set further includes one or more drain ground wires extending along the length of the cable and in capacitive contact with at least one of the first and second conductive shielding films of the conductor set.

Item 22 is the cable of item 1, wherein each conductor set further includes one or more drain ground wires extending along the length of the cable and in resistive contact with at least one of the first and second conductive shielding films of the conductor set.

Item 23 is the cable of item 21 or 22, wherein at least one drain ground wire in the one or more drain wires is disposed between two insulated conductors.

Item 24 is the cable of item 1 further comprising one or more drain ground wires disposed between the separate individual conductor sets.

Item 25 is the cable of item 24, wherein an outermost major surface of at least one conductor set in the plurality of conductor sets is electrically conductive, the one or more drain ground wires making electrical contact with the outermost major surface.

Item 26 is the cable of item 25, wherein the electrically conductive outermost major surface of the at least one conductor set in the plurality of conductor sets comprises one of the first and second conductive shielding films of the at least one conductor set.

Item 27 is the cable of item 21 or 22, wherein at least one drain ground wire in the one or more drain wires is disposed in a pinched portion of the conductor set.

Item 28 is the cable of item 21 or 22, wherein each conductor set includes one drain ground wire.

Item 29 is the cable of item 1, wherein the first and second conductive shielding films comprise at least one of copper, aluminum, and silver.

Item 30 is the cable of item 1, wherein the edges of each conductor set in the plurality of separate individual conductor sets is not sealed.

Item 31 is the cable of item 1, wherein the edges of each conductor set in the plurality of separate individual conductor sets is sealed.

Item 32 is the cable of item 1, wherein the cover portions of the first and second shielding films of each conductor set in combination substantially surround the conductor set by encompassing at least 70% of a periphery of each conductor set.

Item 33 is the cable of item 1, wherein the cover portions of the first and second shielding films of each conductor set in combination substantially surround the conductor set by encompassing at least 80% of a periphery of each conductor set.

Item 34 is the cable of item 1, wherein the cover portions of the first and second shielding films of each conductor set in combination substantially surround the conductor set by encompassing at least 90% of a periphery of each conductor set.

Item 35 is the cable of item 1, wherein the cover portions of the first and second shielding films of each conductor set in combination substantially surround the conductor set by encompassing at least 95% of a periphery of each conductor set.

Item 36 is the cable of item 1 having a transverse round cross-section.

Item 37 is the cable of item 1 having a transverse circular cross-section.

Item 38 is the cable of item 1 having a transverse oval cross-section.

Item 39 is the cable of item 1 having a transverse elliptical cross-section.

Item 40 is the cable of item 1 having a transverse polygonal cross-section.

Item 41 is the cable of item 1 having a transverse square cross-section.

Item 42 is the cable of item 1 having a transverse rectangular cross-section.

Item 43 is the cable of item 1, wherein at least some of the separate individual conductor sets in the plurality of separate individual conductor sets are disposed on an interior perimeter of the cable, each two adjacent conductor sets contacting each other at or near the edges of the conductor sets along at least portions of the length of the cable.

Item 44 is the cable of item 43 wherein any remaining separate individual conductor sets in the plurality of separate individual conductor sets that are not disposed on the interior perimeter of the cable, are disposed within the interior perimeter.

Item 45 is the cable of item 43, wherein all the separate individual conductor sets in the plurality of separate individual conductor sets are disposed on the interior perimeter of the cable.

Item 46 is the cable of item 45, further comprising an insulating core disposed at a center of the interior perimeter and extending along the length of the cable, the core and the jacket maintaining relative positions of the separate individual conductor sets in the plurality of separate individual conductor sets.

Item 47 is the cable of item 46, wherein the insulating core has a transverse round cross-section.

Item 48 is the cable of item 1, wherein:

some separate individual conductor sets in the plurality of separate individual conductor sets are disposed on an interior perimeter of the cable, and some other separate individual conductor sets in the plurality of separate individual conductor sets are disposed within the interior perimeter; and wherein one or more insulative cores are disposed on the interior perimeter and extend along the length of the cable, each insulative core disposed on the interior perimeter being between two conductor sets disposed on the interior perimeter.

Item 49 is the cable of item 48, wherein each insulating core in the one or more insulating cores has a transverse round cross-section.

Advantages and features described for the embodiments illustrated in the figures should be considered fully interchangeable or modifiable and any or all of them may be appropriate to include in embodiments of the present disclosure. The present invention should not be considered limited to the particular examples and embodiments described above, as such embodiments are described in detail in order to facilitate explanation of various aspects of the invention. Rather, the present invention should be understood to cover all aspects of the invention, including various modifications, equivalent processes, and alternative devices falling within the scope of the invention as defined by the appended claims and their equivalents.

What is claimed is:

1. A cable comprising:

a plurality of separate individual conductor sets, each conductor set extending along a length of the cable and comprising:

two insulated conductors;

first and second conductive shielding films disposed on opposite first and second sides of the conductor set, the first and second conductive shielding films including cover portions and pinched portions arranged such that, in transverse cross section, the cover portions of the first and second shielding films in combination substantially surround the conductor set, and the pinched portions of the first and second shielding films in combination form pinched portions of the conductor set on each side of the conductor set, each pinched portion comprising an edge extending along the length of the cable; and an insulating jacket surrounding the plurality of the conductor sets.

2. The cable of claim 1 further comprising an outer shielding film surrounding the plurality of the conductor sets, the insulating jacket surrounding the outer shielding film.

3. The cable of claim 1 further comprising an adhesive layer bonding the first shielding film to the second shielding film in the pinched portions of the conductor set.

4. The cable of claim 1, wherein the edges of each conductor set in the plurality of separate individual conductor sets is not sealed.

5. The cable of claim 1, wherein at least some of the separate individual conductor sets in the plurality of separate individual conductor sets are disposed on an interior perimeter of the cable, each two adjacent conductor sets contacting each other at or near the edges of the conductor sets along at least portions of the length of the cable.

6. The cable of claim 5 wherein any remaining separate individual conductor sets in the plurality of separate individual conductor sets that are not disposed on the interior perimeter of the cable, are disposed within the interior perimeter.

7. The cable of claim 5, wherein all the separate individual conductor sets in the plurality of separate individual conductor sets are disposed on the interior perimeter of the cable.

8. The cable of claim 7, further comprising an insulating core disposed at a center of the interior perimeter and extending along the length of the cable, the core and the jacket maintaining relative positions of the separate individual conductor sets in the plurality of separate individual conductor sets.

9. The cable of claim 8, wherein the insulating core has a transverse round cross-section.

10. The cable of claim 1, wherein:

some separate individual conductor sets in the plurality of separate individual conductor sets are disposed on an interior perimeter of the cable, and some other separate individual conductor sets in the plurality of separate individual conductor sets are disposed within the interior perimeter; and wherein one or more insulative cores are disposed on the interior perimeter and extend along the length of the cable, each insulative core disposed on the interior perimeter being between two conductor sets disposed on the interior perimeter.

11. The cable of claim 10, wherein each insulating core in the one or more insulating cores has a transverse round cross-section.

12. The cable of claim 1, wherein each conductor set extends along the entire length of the cable.

13. The cable of claim 1, wherein a wire diameter of each insulated conductor of each conductor set in the plurality of separate individual conductor sets is not greater than 20 AWG.

14. The cable of claim 1, wherein each insulated conductor of each conductor set in the plurality of separate individual conductor sets has a nominal characteristic impedance in a range of 40-60-ohms.

15. The cable of claim 1, wherein each insulated conductor of each conductor set in the plurality of separate individual conductor sets has a nominal characteristic impedance in a range of 45-55 ohms.

* * * * *